US007389560B2

(12) United States Patent
Mertins, Jr.

(10) Patent No.: US 7,389,560 B2
(45) Date of Patent: Jun. 24, 2008

(54) REMOTELY ACTUATED PAINT ROLLER COVER DISPENSING FRAME

(76) Inventor: Orville Lee Mertins, Jr., 30 Ferguson Rd., Whitesboro, TX (US) 76273

( * ) Notice: Subject to any disclaimer, the term of this patent is extended or adjusted under 35 U.S.C. 154(b) by 63 days.

(21) Appl. No.: 11/415,814

(22) Filed: May 2, 2006

(65) Prior Publication Data

US 2007/0256268 A1 Nov. 8, 2007

(51) Int. Cl.
*B05C 1/08* (2006.01)
*B05C 17/02* (2006.01)

(52) U.S. Cl. ..... 15/230.11; 492/13; 492/19

(58) Field of Classification Search ..... 15/230.11, 15/233; 492/13, 19
See application file for complete search history.

(56) References Cited

U.S. PATENT DOCUMENTS 2,916,755 A * 12/1959 De Bozzay ..... 401/197
3,060,555 A * 10/1962 Kirshenbaum et al. ..... 492/19
3,447,184 A 6/1969 McGinley
3,751,748 A 8/1973 Roe et al.
3,916,470 A 11/1975 May
4,196,491 A 4/1980 Baril
4,317,248 A 3/1982 Smith
4,597,684 A 7/1986 O'Brien et al.
5,288,161 A 2/1994 Graves et al.
5,345,648 A 9/1994 Graves
5,509,165 A 4/1996 Zigelboim et al.
5,806,131 A 9/1998 Tennant
6,574,824 B2 6/2003 Burns et al.
6,681,438 B2 1/2004 Newman et al.
6,687,945 B2 2/2004 Robinson
6,941,609 B2 9/2005 Woodruff et al.
2006/0130261 A1* 6/2006 Futo et al. ..... 15/230.11

FOREIGN PATENT DOCUMENTS

WO PCT/US99/30954 6/2000

* cited by examiner

*Primary Examiner*—David B Thomas
(74) *Attorney, Agent, or Firm*—Schultz & Associates, P.C.

(57) ABSTRACT

The invention disclosed herein provides a system, apparatus and method for removing a paint roller cover from a paint roller frame. The paint roller frame includes a handle having a movable button, a hollow support shaft, a roller support pivotally attached to the hollow support shaft, a spring mechanism and a cable that is connected to the button and the roller support. The paint roller cover is released from the paint roller frame by pressing the button. When the button is pressed the cable is pulled towards proximally. As the cable is pulled proximally, the roller support is moved towards the spring mechanism. The movement of the roller support towards the spring mechanism causes the spring mechanism to transform into a position to release the paint roller cover.

32 Claims, 12 Drawing Sheets

REMOTELY ACTUATED PAINT ROLLER COVER DISPENSING FRAME

FIELD OF THE INVENTION

This invention relates to a system, apparatus and method that permit a user to engage and displace a paint roller cover onto and from a paint roller frame quickly, cleanly and efficiently. In particular, the invention relates to a system, apparatus and method that use a remotely actuated star spring to permit the user to easily and quickly remove the paint roller cover from the paint frame without having to touch the wet paint roller cover.

BACKGROUND

Paint roller dispensers are generally known in the art and can range from very complex devices to those of extreme simplicity. Often after a user is done painting, he has to grasp the paint roller cover, full of paint, with his hand or around the edge of a bucket and physically remove the roller from the dispenser. This process is fairly inefficient, and messy as the user becomes covered in paint because he had to touch the paint filled roller to remove the roller from the dispenser.

Several solutions have been proposed in order to alleviate this problem. For example, U.S. Pat. No. 3,447,184 to McGinley discloses a paint roller frame that facilitates removal of a paint roller sleeve. The paint roller frame comprises an inner end cap and an outer end cap for rotatably supporting the roller on the frame, a gripper means on the axle of the frame for preventing axial movement of the sleeve relative to the frame and a means for removal of the sleeve. The sleeve is removed from the frame by manually moving the inner end cap towards the outer end cap. The means for removal of the sleeve is not remotely actuated by use of a cable.

U.S. Pat. No. 3,751,748 to Roe discloses a roller frame that includes an expandable core on the roller frame shaft. The expandable core has a plurality of expandable fingers. The fingers are forced radially outward during axial movement of the expandable core in one direction relative to an axially stationary cam hub on the shaft. Thus, the fingers frictionally engage the inner diameter of the paint roller cover. The paint roller cover is removed by the application of thumb pressure to the inboard end of the expandable core. When the inboard end is pressed, the expandable fingers are moved radially inward. When the expandable fingers are moved radially inward, this removes the locking tension of the cam hub by forcing the expandable core in the opposite direction. The expandable core is not spring loaded nor does it include a star spring that is remotely actuated by use of a cable.

PCT Application WO00/37184 to Babkowski discloses a paint roller frame that includes an end cap assembly. The end cap assembly comprises a push button and a cam member having a plurality of angularly spaced apart fingers. The fingers on the cam member are normally biased radially outward causing the tips of the fingers to engage the inner surface of the paint roller cover. To remove the paint roller cover from the frame, the button on the end cap is manually pressed. When the push button is pressed, the fingers move radially inward causing the tips to disengage from the inner surface of the paint roller cover. Babkowski does not disclose a use of a star spring or use of a cable to remotely actuate the fingers.

The inventions disclosed in McGinley, Roe and Babkowski all contained a removal mechanism that is attached to or near where the paint roller cover attaches to the roller frame. Since the removal mechanism is attached to or near where the paint roller cover attaches to the roller frame, the removal mechanism will get covered in paint during use of the paint roller. Thus, it would be beneficial to provide a paint roller apparatus that allows a user to remotely engage and disengage a paint roller cover from a paint roller frame quickly, cleanly and efficiently.

BRIEF SUMMARY OF THE INVENTION

The invention disclosed herein provides a system, apparatus and method for removing a paint roller cover from a paint roller frame. The invention comprises a flexible cable threaded from a button in the handle through an engagement means, through a frame to an end cap. The spring mechanism comprises a star spring, a collar and a roller pivot. When the button is pressed, the flexible cable pulls the roller towards the engagement means. When the roller is pulled towards the engagement means, the star spring is warped as a result of the roller exerting a force on the star spring's center. As the star spring is warped, the springs' prongs are retracted. With the prongs retracted, the paint roller cover can easily be placed onto the frame or removed from the frame.

In another embodiment of this invention, the invention also comprises a flexible cable threaded from a button in the handle, through an spring mechanism through a frame to an end cap. The spring mechanism comprises a star spring and a roller pivot. When the button is pressed, the flexible cable pulls the frame towards the engagements means. The offset in cylindrical diameters between the base of the frame and the star spring cause the base of the frame to be brought over the diameter of the star spring. As the base of the frame is moved towards the roller pivot, it exerts a force on the outside circumference of the star spring. This force warps the star spring, thereby retracting the star springs' prongs. With the prongs retracted, the paint roller cover can easily be removed from the frame.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENTS

Figure 1:
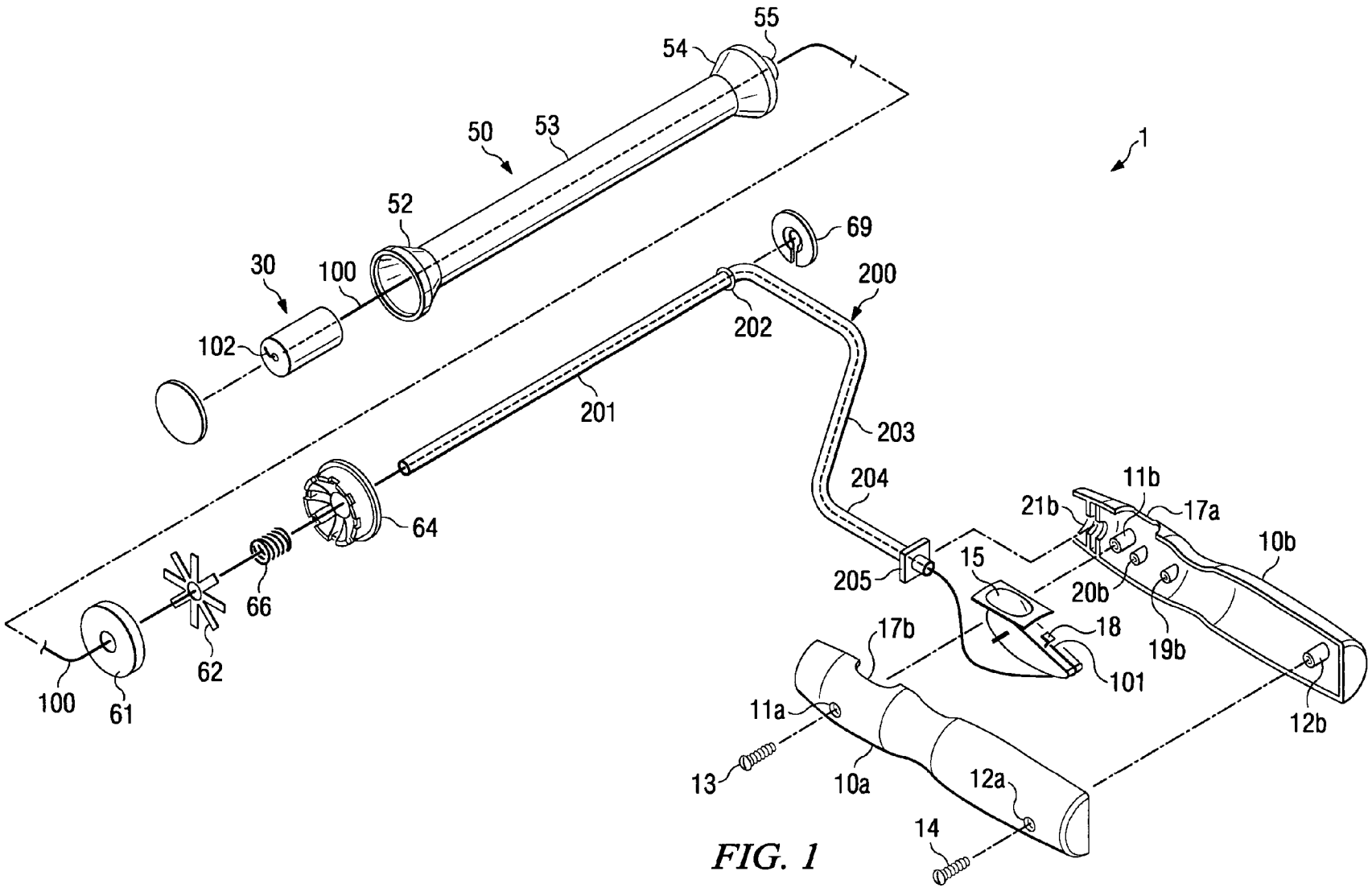
FIG. 1 is a perspective exploded view of various parts of one embodiment of the present invention.

Referring to FIG. 1, a preferred embodiment of the paint roller frame 1 is shown. Handle sections 10*a* and 10*b* are molded plastic halves that form a complete handle when assembled. They are composed of plastic such as polypropylene. However, in other embodiments, other materials such as metal or rubber will suffice. Handle section 10*a* is connected to handle section 10*b* by screw 13 and screw 14. Screw 13 extends through screw hole 11*a* into threaded stanchion 11*b* and screw 14 extends through screw hole 12*a* into threaded stanchion 12*b*, thereby securing handle section 10*a* to handle section 10*b*. The present invention is not limited to using screws to secure the handle sections together, as other types of fasteners well known in the art, such as tabs, adhesives or welds may be used with equal success. Handle section 10*a* includes semicircular cutout 21*a*. Handle section 10*b* includes semicircular cutout 21*b*. Together the semicircular cutouts 21*a* and 21*b* form a button hole into the interior of the handle.

Figure 1A:
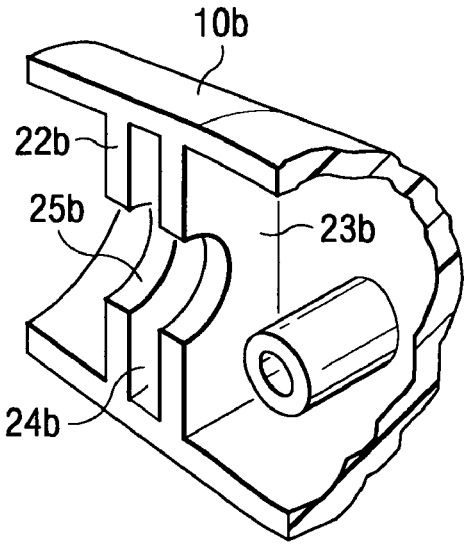
FIG. 1*a* is an isometric view of a portion of one embodiment of the present invention.

Handle sections 10*a* and 10*b* include square channels 24*a* and 24*b*, respectively. As shown in FIG. 1A, square channel 24*b* is formed by shelf supports 22*b* and 23*b*. Square channel 24*a* is formed by shelf supports 22*a* and 23*a*. Square channels 24*a* and 24*b* include semicircular openings 25*a* and 25*b*. When the handle is assembled, square washer 205 fits in square channels 24*a* and 24*b* and semicircular openings 25*a* and 25*b* form a hole for passage of hollow support shaft 200.

Hollow support shaft 200 is a hollow aluminum tube. However, in other embodiments, the hollow support shaft may be composed of different materials such as plastic or steel alloy. Hollow support shaft 200 includes horizontal support section 201, lug 202, curved support section 203, vertical support section 204 or square washer 205. Horizontal support section 201, curved support section 203 and vertical support section 204 are a single integrated piece. In the preferred embodiment, lug 202 and square washer 205 are secured to hollow support shaft via welding. Other means of rigid attachment will suffice. In the preferred embodiment, lug 202 is a circular washer with an outer diameter of ¾". Square washer 205 is approximately ¾ths square inches.

When the handle is assembled, square channels 24*a* and 24*b* prevent square washer 205 from moving, thereby preventing hollow support shaft 200 from rotating about its axis or moving axially within the handle during use. Other shapes may be used for square washer 205 so long as these shapes prevent hollow support shaft from rotating within the handle sections during use. Further, other means to prevent rotation of the hollow shaft may also be apparent to those of skill in the art, such as an adhesive or inductive heat welding.

Figure 2:
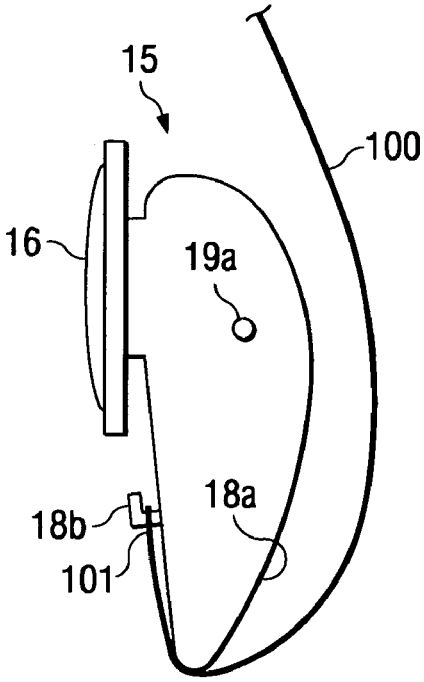
FIG. 2 is a side elevation view of the button member of one embodiment of the present invention.

When the handle is assembled, button member 15 is pivotally fixed between handle section 10*a* and handle section 10*b*. FIG. 2 shows a more detailed view of button member 15. Button member 15 comprises contact surface 16, curved wire support 18*a*, wire support hook 18*b*, pivot pin 19*a* and pivot pin 20*a*. In the preferred embodiment, button member 15 is composed of polyethylene plastic and is an assembled integral piece. Other materials well known in the art, such as metal, will work equally well. Pivot pin 19*a* fits in pivot hole 19*b* on handle section 10*b*. Pivot pin 20*a* fits in pivot hole 20*b* on handle section 10*a*. The pivot pins allow rotation of the button member within the handle. Contact surface 16 protrudes through the button hole formed by semicircular cutouts 17*a* and 17*b* in handle sections 10*a* and 10*b*, respectively.

Proximal end 101 of activator cable 100 is secured to wire support hook 18*b* and is threaded around curved wire support 18*a*. A channel is provided in the curved wire support to facilitate passage of the cable. In the preferred embodiment, proximal end 101 attaches to wire support hook 18*b* by a loop in the cable. However in other embodiments, activator cable 100 may be secured to wire support hook 18*b* through other means well known in the art, such as a clip, adhesive or welding.

Activator cable 100 further extends from curved wire support 18*a* through the length of hollow support shaft 200. At its distal end 102, activator cable 100 is attached to end cap 30 by an adhesive. In other embodiments, a mechanical attachment such as a hook and loop can also be employed. In the preferred embodiment, activator cable 100 is a flexible wire cable that is approximately 24" long and formed of steel strands. However the invention is not limited in this regard, and the activator cable can be a chain, rope, string, flexible cable or other similar products known to those of ordinary skill in the art.

Figure 3:
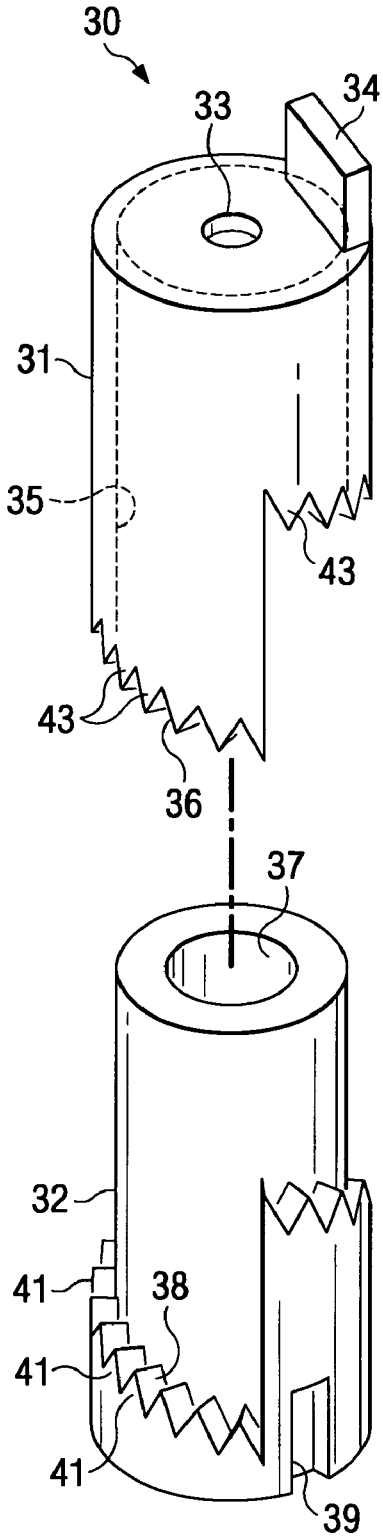
FIG. 3 is an exploded isometric view of the end cap of one embodiment of the present invention.

As shown in FIG. 3, end cap 30 includes centering cylinder 31 and receiving cylinder 32. Centering cylinder 31 is a generally cylindrical body which includes tab 34, centering hole 35, hole 33 and helical extension face 36. Receiving cylinder 32 is a generally cylindrical body which includes receiving hole 37, helical extension face 38 and notch 39. Helical extension faces 36 and 38 have serrated teeth 41 and 43, respectively. When assembled, receiving cylinder 32 resides inside centering hole 35 and helical extension face 36 is brought into contact with helical extension face 38. The serrated teeth on the helical extension faces engage to changeably fix the rotational and axial positions of centering cylinder 31 and receiving cylinder 32 with respect to each other.

Figure 4:
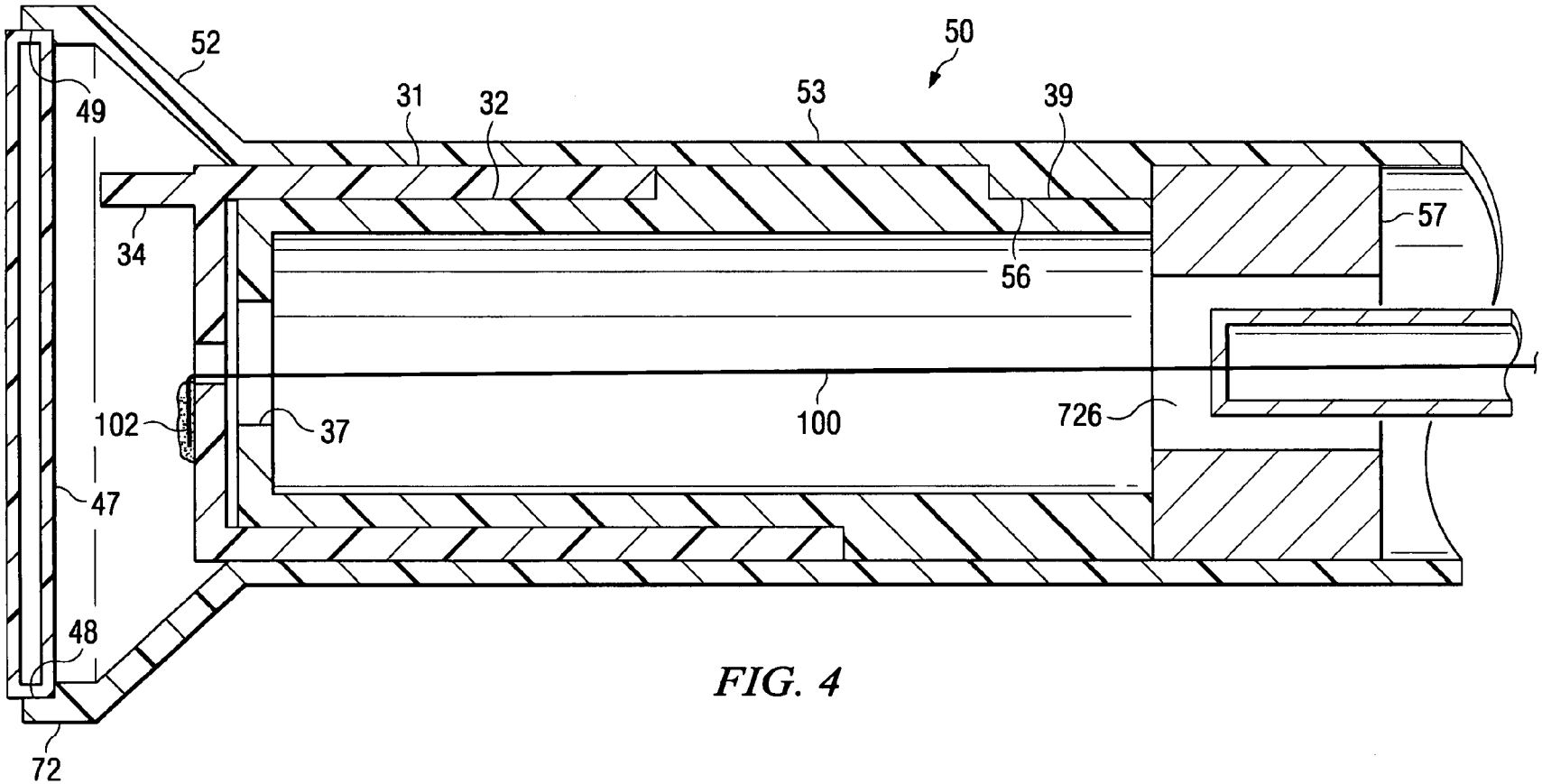
FIG. 4 is a cross section view of the end cap.
Figure 7:
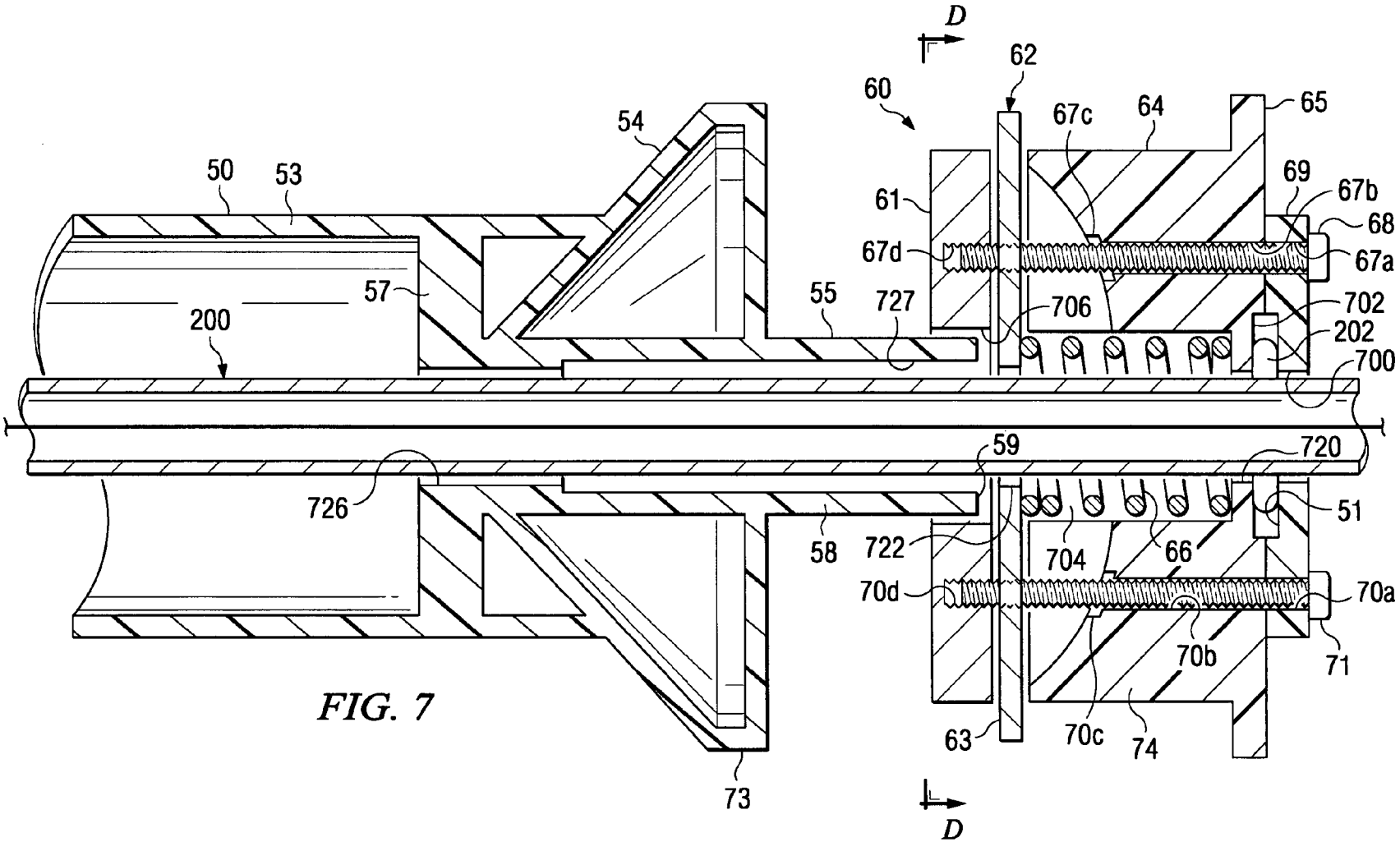
FIG. 7 is perspective view of one embodiment of the present invention in an unbiased position.
Figure 8B:
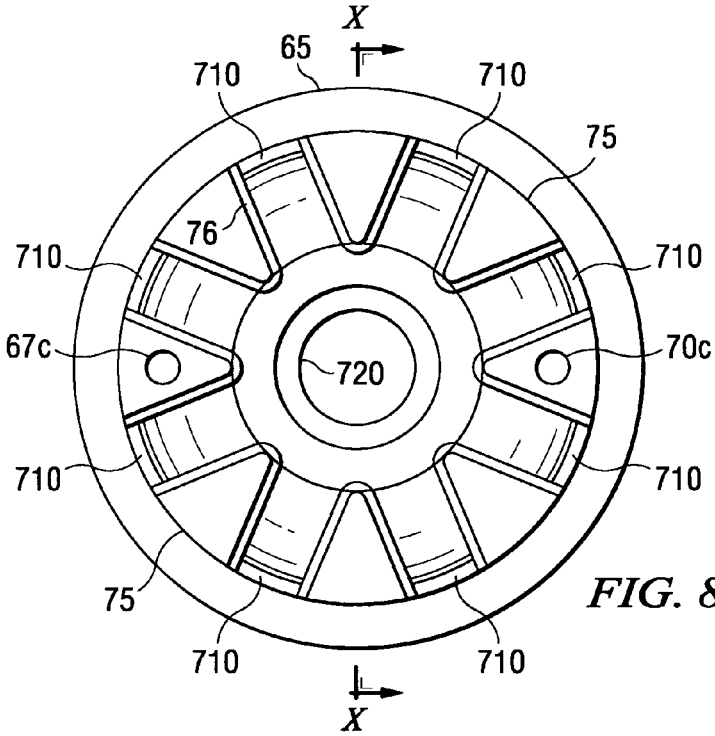
FIG. 8*b* is a down elevation view of a portion of one embodiment of the present invention.
Figure 8C:
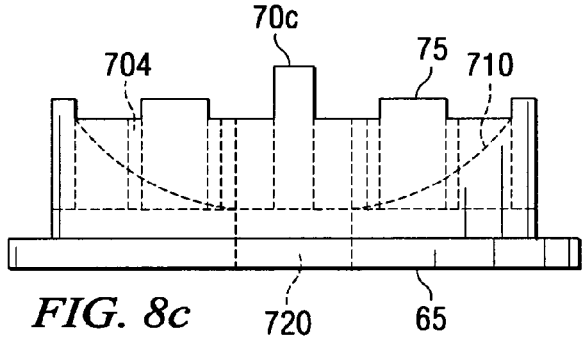
FIG. 8*c* is an elevation view of a portion of one embodiment of the present invention.
Figure 8D:
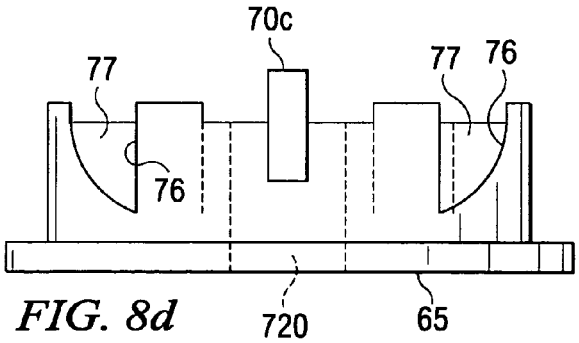
FIG. 8*d* is an elevation view of a portion of one embodiment of the present invention.
Figure 8E:
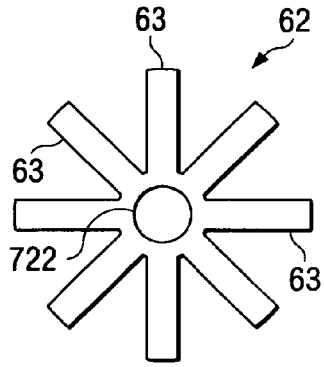
FIG. 8*e* is a plan view of a portion of one embodiment of the present invention.

As shown in FIGS. 1, 4 and 7 end cap 30, when assembled, resides in roller support 50. Roller support 50 comprises end cover 47, distal frustroconical section 52, cylinder section 53, proximal frustroconical section 54 and plunger 55. In the preferred embodiment, roller support 50 is composed on plastic such as polypropylene; however other materials such as metal alloys may be used with equal success. Distal frustroconical section 52 includes a cylindrical support surface 72 which is sized to fit within and support the distal end of the paint roller cover. In the preferred embodiment, end cover 47

"snaps" into distal frustroconical section 52 by means of receiving notches 48 and 49. However end cover 47 may be secured to the distal frustroconical section by other means such as by an adhesive.

Cylindrical section 53 forms a hollow cylindrical tube that connects distal frustroconical section 52 at its distal end and proximal frustroconical section 54 at its proximal end. Cylindrical section 53 includes locking tab 56 and shoulder 57 at its distal end. Centering cylinder of end cap 30 is prevented from rotating in distal frustroconical section 52 by the combination of receiving notch 39 with locking tab 56. In the preferred embodiment, an adhesive is used to secure receiving notch 39 with locking tab 56; however this is not required. Shoulder 57 is a cylindrical roller bushing that extends from the inside walls of cylindrical section 53 to support the distal end of the hollow support shaft and allow for its steady rotation. In the preferred embodiment, the receiving cylinder is fixed to the shoulder with an adhesive. Hole 726 is formed by shoulder 57. Hole 726 has a diameter of approximately 7/16". The diameter of hole 726 is slightly larger than the diameter of hollow support shaft 200 in order to allow roller support 50 to rotate about hollow support shaft 200.

Proximal frustroconical section 54 extends outwardly from cylindrical section 53 to support surface 73. Support surface 73 is sized to fit within and partially support the proximal end of the paint roller cover. Attached to proximal frustroconcial section 54 is plunger 55. Plunger 55 includes body 58 and end 59. Body 58 is a hollow cylinder that includes hole 727. The diameter of hole 727 is 7/16". The outside diameter of body 58 is 3/8". Body 58 travels through hole 706 on collar 61. End 59 engages star spring 62. Those skilled in the art will appreciate that a tolerance of 1/16" between hole 726, hole 727 and hollow support shaft 200 will allow for rotation.

Figure 5:
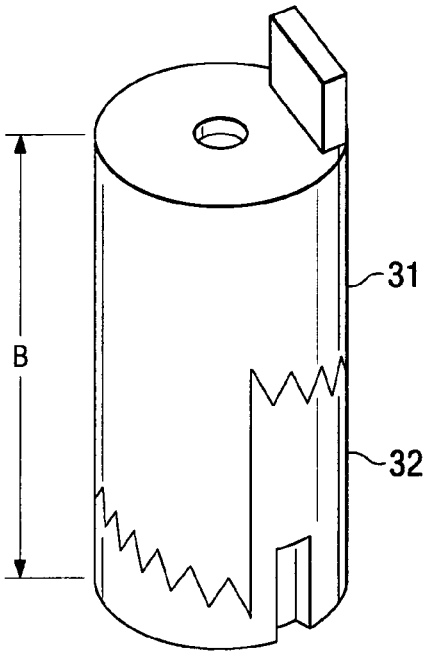
FIG. 5 is a perspective view of portion of one embodiment of the present invention in an unextended position.
Figure 6:
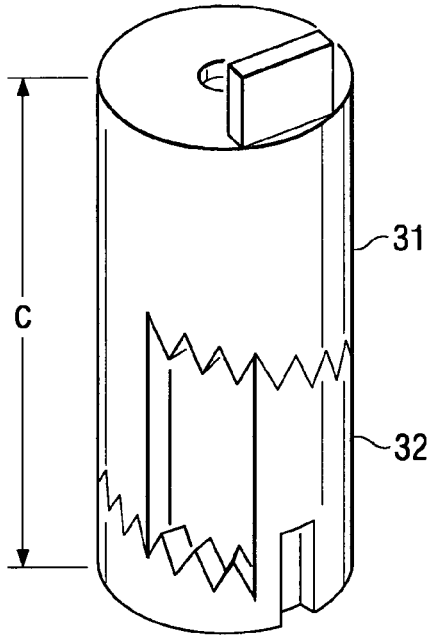
FIG. 6 is a perspective view of portion of one embodiment of the present invention in an extended position.

End cap 30 is used to adjust the position of roller support 50 with respect to the spring mechanism. By rotating centering cylinder 31 with respect to receiving cylinder 32, the length of the end cap may be varied. FIG. 5 shows end cap in its shortest length. If roller support 50 needs to be moved distally away from spring mechanism 60, centering cylinder 31 is rotated clockwise with respect to receiving cylinder 32. As centering cylinder 31 is rotated clockwise, the distance between the top of centering cylinder 31 and the bottom of receiving cylinder 32 is increased. For example, when centering cylinder 31 and receiving cylinder 32 are in the position as shown in FIG. 6, the distance C as shown in FIG. 6 is greater than distance B as shown in FIG. 5. The increase in distance forces the roller support in a proximal direction along the hollow support shaft toward the spring mechanism because the position of tab 34 is fixed relative to the cable by the connection to the distal end of the cable. If roller support 50 needs to be moved proximally toward spring mechanism 60, centering cylinder 31 is rotated counterclockwise. Adjustment of the end cap may also be used to control the extent that plunger 55 biases star spring 62.

Figure 9:
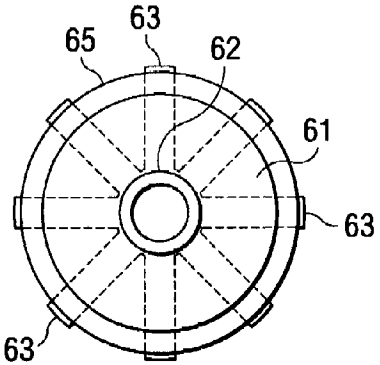
FIG. 9 is an end elevation view of FIG. 7 as seen from the plane across line D-D.

FIG. 7 shows the assembled positions of the roller support and the spring mechanism 60 on hollow support shaft 200 in an unretracted position. FIG. 9 shows a portion of spring mechanism 60 in an unretracted position. Spring mechanism 60 comprises collar 61, star spring 62, roller 64, coil spring 66 and retaining ring 69. Star spring 62 is shown in an unretracted position.

Collar 61 in the preferred embodiment, is a flat disk having hole 706 and threaded holes **67*d* and 70*d*. The diameter of hole 706 is greater than the outside diameter of plunger 55. In the preferred embodiment the diameter is approximately 3/8". A tolerance of approximately 1/16" between the diameter of hole 706 and the outside diameter of plunger 55 is provided. In the preferred embodiment, collar 61** has an outer diameter of approximately of approximately 1 3/8" and the collar is composed of plastic such as polypropylene; however other materials may be used with equal success.

Star spring 62 is adjacent collar 61. FIG. **8*e* shows a plan view of star spring 62. Star spring 62 is composed of a thin flexible spring steel. In the preferred embodiment the star spring is a high carbon low alloy steel approximately 1/32" thick. In the preferred embodiment star spring 62 has eight prongs, 63, that extend to a diameter of approximately 1 1/2". In other embodiments, the star spring can have a different number of prongs. Star spring 62 also includes hole 722. The diameter of hole 722 is greater than hollow support shaft 200. A tolerance of 1/16" is provided between the diameter of hole 722 and hollow support shaft 200** to allow rotation. In the preferred embodiment, the outer diameter of the prongs is about 10% larger than the outer diameter of the collar and the roller body. It is preferred to have the diameter of the prongs between 5% and 25% larger than the internal diameter of the paint roller cover.

Returning to FIG. 7, roller 64 is adjacent star spring 62. Roller 64 comprises roller body 74 and lip 65. Roller 64 is composed of plastic such as polypropylene; however other materials may be used with equal success. Roller body 74 has an outer diameter of approximately 1 3/8" and an inner diameter of approximately 3/8".

FIG. **8*b* shows a plan view of roller body 74. Roller body 74 comprises concave radial slots 710, triangular stanchions 75, holes 67*b* and 70*b*, hollow stanchions 67*c* and 70*c*, hole 720 and spring retaining cavity 704**.

As shown in FIGS. **8*b*, 8*c* and 8*d*, the interior of the roller body includes several inward facing triangular stanchions. In the preferred embodiment there are six. The triangular stanchions extend out of the roller body. On the exterior of each triangular stanchion within the roller body is a concave guide shelf 76. The guide shelves on the opposing faces of the triangular stanchions form concave radial slots 710**.

Concave radial slots 710 are openings where star spring prongs 63 rest. Concave radial slots 710 retain and restrict star spring prongs 63 within roller 64. Concave radial slots 710 also guide the star spring's movement during use. Each concave radial slot forms a slide to direct a single prong of the star spring. Those skilled in the art will recognize that when the star spring is placed in the roller body and its center depressed, the concave radial slots cradle the prongs. When released, the prongs of the star spring are guided by the slots to their original positions without jamming.

Spring retaining cavity 704 is a cylindrical cavity within roller body 74 that has a diameter of about 3/4". Spring retaining cavity 704 retains coil spring 66 within roller 64. Coil spring 66 is a helical compression spring with a free length of 1/2".

The diameter of hole 720 is greater than the diameter of hollow support shaft 200. A tolerance of 1/16" between the diameter of hole 720 and the diameter of hollow support shaft 200 in order to allow rotation.

Lip 65 is connected to roller body 74. Lip 65 includes cavity 702. Lug 202 fits into cavity 702 and prevents spring mechanism from moving axially with respect to hollow support shaft 200. The outer diameter of lip 65 is approximately 1 5/8". The diameter of lip 65 may vary as long as it is sufficiently large enough to form an abutment for the paint roller cover.

Figure 10:
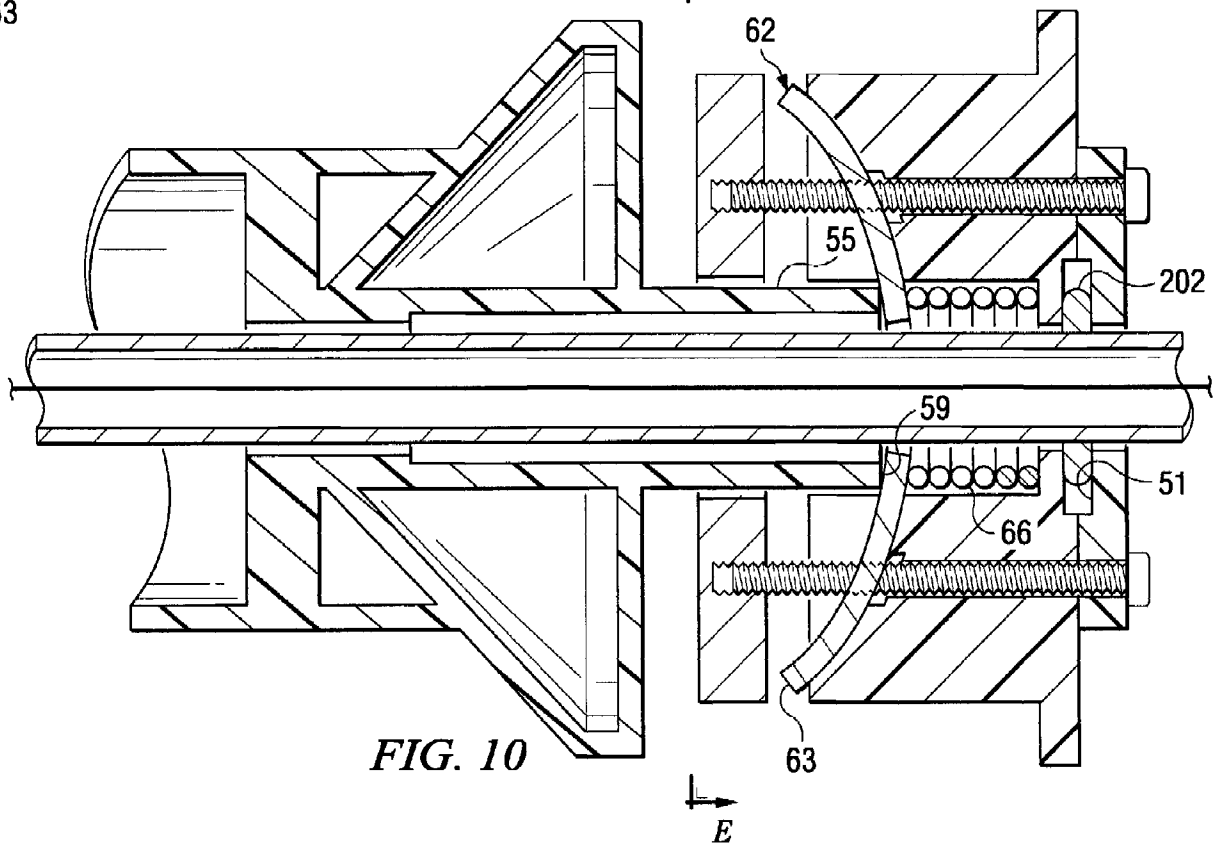
FIG. 10 is a cross-sectional view of one embodiment of the present invention in a biased position.

Referring to FIGS. 7 and 10, retaining ring 69 is a flat disk having a hole 700 and a cavity 51 through holes **67*a* and 70*a*. The diameter of hole 700 is greater than hollow support shaft 200. A tolerance of 1/16" between the diameter of hole 700 and hollow support shaft 200 is provided to allow rotation. In the preferred embodiment, retaining ring 69 has an outside diameter of approximately 1⅜" and an inner diameter of approximately ½". In the preferred embodiment, retaining ring 69 is formed with plastic such as polypropylene but machined cast light metals or plastics will work equally well. Lug 202 fits into cavity 51 and prevents spring mechanism 60** from moving axially with respect to the hollow support shaft.

Figure 8A:
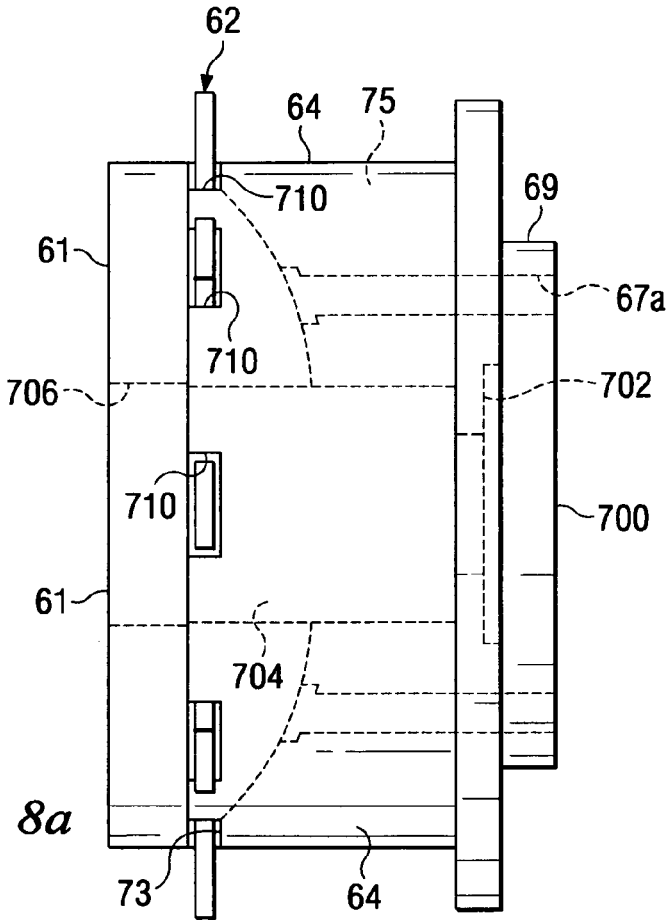
FIG. 8*a* is a side elevation view of a portion of one embodiment of the present invention.

When the spring mechanism is assembled, coil spring 66 is located in spring retaining cavity 704 around hollow support shaft 200. Star spring 62 fits in concave radial slots 710 in roller body 74 as shown in FIG. 8*a*. Star spring 62 is in contact with coil spring 66. Star spring 62 is held within concave radial slots 710 by collar 61. Retaining ring 69, roller 64 and collar 61 are held together by screw 68 and screw 71. Screw 68 passes through holes 67*a* and 67*b* and hollow stanchion 67*c* and threads into threaded hole 67*d*. Screw 71 passes through holes 70*a* and 70*b* and hollow stanchion 70*c* and threads into threaded hole 70*d*.

Figure 11:
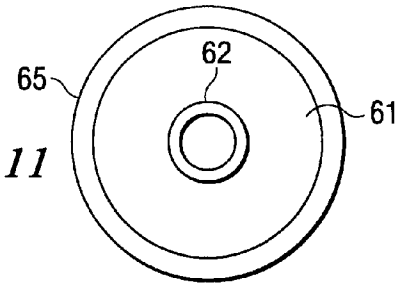
FIG. 11 is an end elevation view of FIG. 10 as seen from the plane across line E-E.

In operation, to remove a paint roller cover from paint roller frame 1 or to attach a paint roller cover to paint roller support 50, star spring 62 must be in a retracted position. To retract star spring 62, contact surface 16 is pressed. When contact surface 16 is pressed, pivot pin 19*a* and pivot pin 20*a* rotates and in pivot holes 19*b* and 20*b*, respectively. As pivot pin 19*a* and pivot pin 20*a* rotate, activator cable 100 is pulled in a proximal direction by the rotation of curved wire support 18*a*. Activator cable 100 in turn moves end cap 30. Roller support 50 is pushed towards spring mechanism 60 by pressure exerted on its distal end by end cap 30. As roller support 50 moves towards spring mechanism 60, plunger 55 pushes the center of star spring 62 and coil spring 66 toward the proximal end of the hollow support shaft. As shown in FIG. 10, when the center of star spring 62 is pressed, it bends and star spring prongs 63 are retracted within the spring mechanism. FIGS. 10 and 11 show star spring 62 in a retracted position. When spring star 62 is in a retracted position the paint roller cover can easily be slid onto or off of paint roller frame 1.

To secure the paint roller cover onto paint roller frame 1, the pressure on contact surface 16 is released. As the pressure on contact surface 16 is released, plunger 55 is pushed in a distal direction by the recoil of the coil spring. Roller support 50 is moved in a distal direction. The recoil of coil spring 66 also pushes star spring 62 back into its unretracted position, allowing its prongs to be extended outside the spring mechanism. The extended prongs of the star spring contact the inside of the paint roller cover thereby preventing the paint roller cover from sliding relative to paint roller frame 1.

Figure 12:
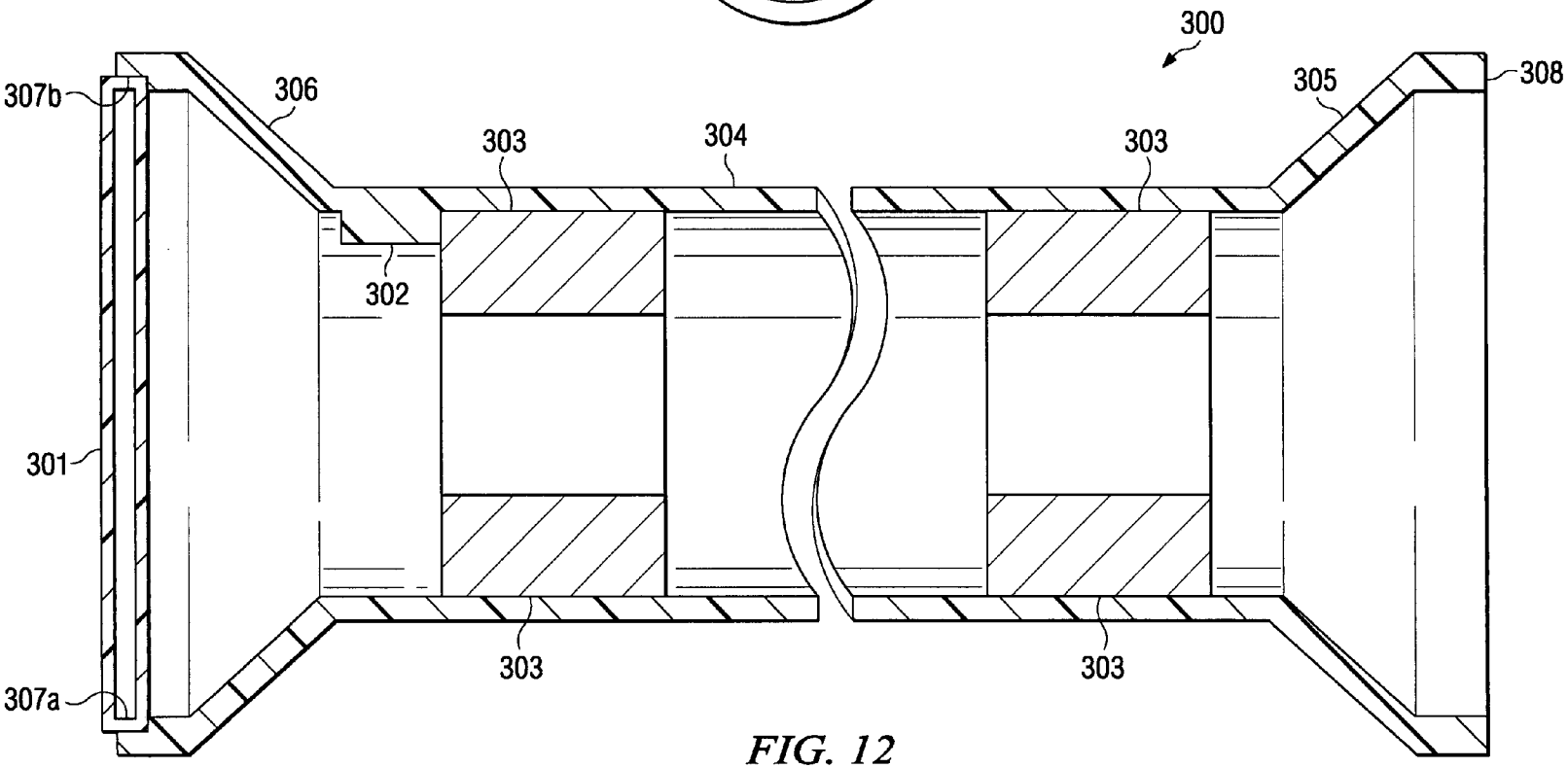
FIG. 12 is a side elevation view of another embodiment of the present invention.

FIGS. 12 through 16 show another embodiment of this invention. FIG. 12 shows roller support 300. Roller support 300 comprises end cover 301, distal frustroconical section 306, cylindrical section 304 and proximal frustroconical section 305. In the alternate embodiment, roller support 300 is composed of plastic such as polypropylene; however other materials such as metal may be used with equal success. In the preferred embodiment, end cover 301 "snaps" into distal frustroconical section 306 by means of receiving notches 307*a* and 307*b*. However end cover 301 may be secured to the distal frustroconical section by other means generally known in the art such as by an adhesive.

Cylindrical section 304 includes locking tab 302 and shoulder 303. An end cap, similar to end cap 30 as described above, attaches to locking tab 302. Shoulder 303 is a cylindrical roller bushing that extends from the inside walls of cylindrical section 304 to support the distal end of the hollow support shaft. In this alternate embodiment, the receiving cylinder is fixed to the shoulder with an adhesive. Hole 311 is formed by shoulder 303. The diameter of hole 311 is slightly larger than the diameter of hollow support shaft 200 thereby allow roller support 300 to rotate about hollow support shaft 200.

Proximal frustroconical section 305 is connected to cylindrical section 304. The outside diameter of proximal frustroconcial section is 1½". Proximal frustroconical section 305 includes cylindrical support 312. Cylindrical support 312 is sized to support the inside of the paint roller cover. The cylindrical support includes edge 308 and is adjacent star spring 404.

Figure 14:
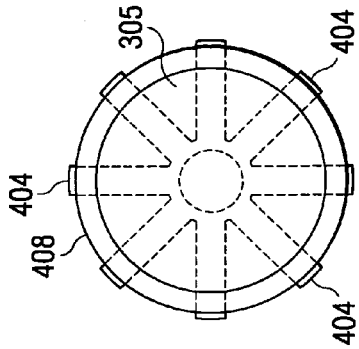
FIG. 14 is an end elevation view of FIG. 13 as seen from the plane across line G-G.
Figure 13:
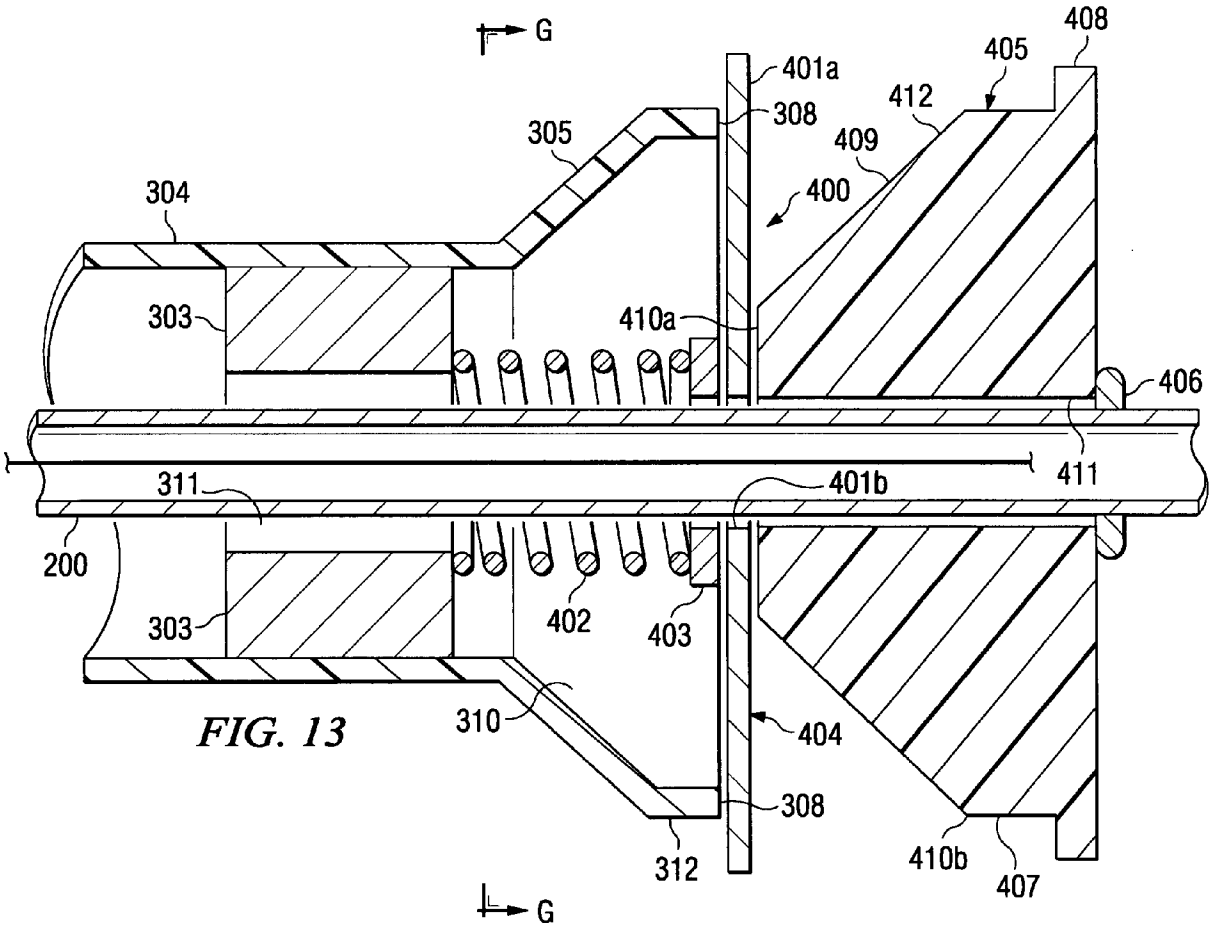
FIG. 13 is a cross-sectional view of one embodiment of the present invention in an unbiased position.
Figure 15:
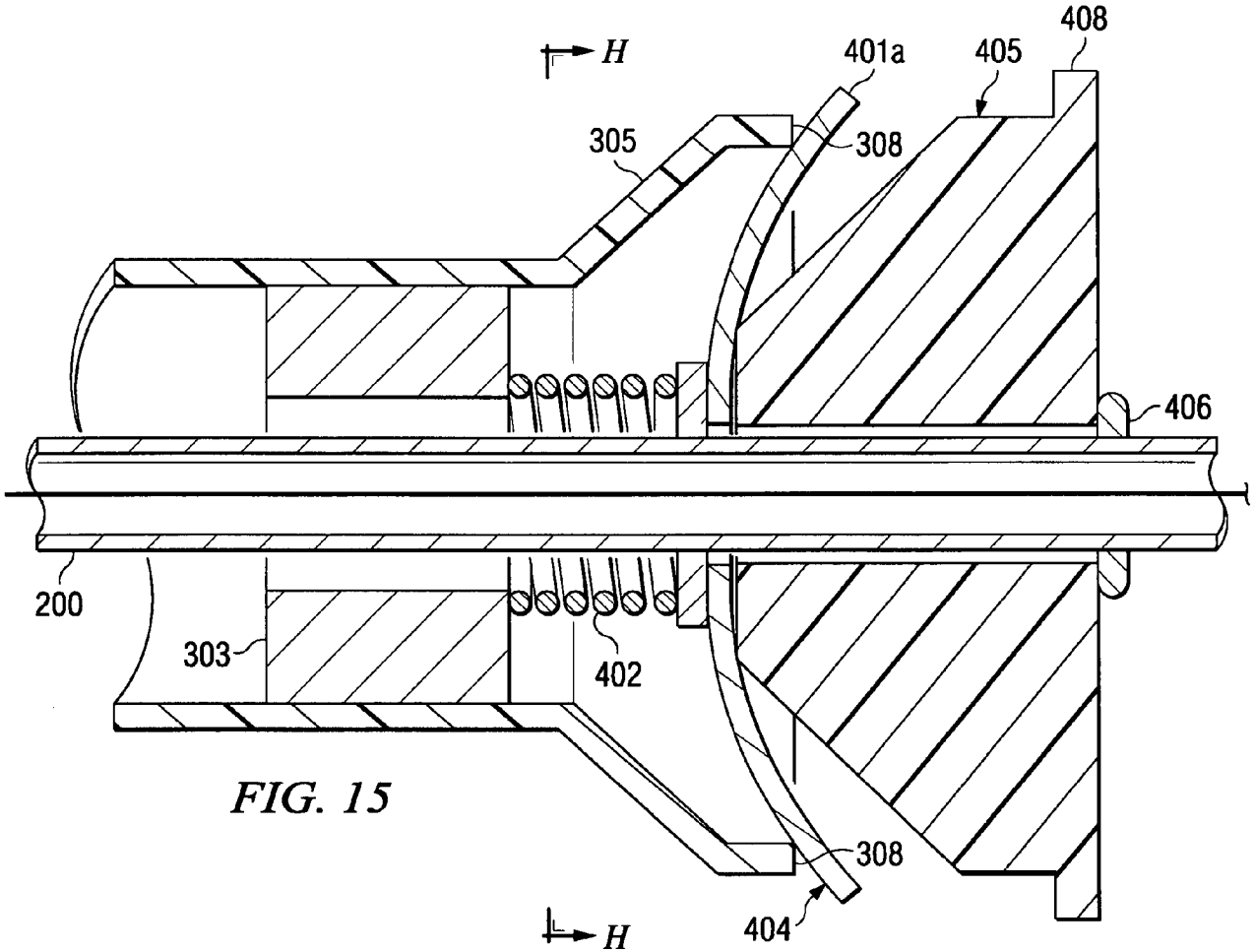
FIG. 15 is a cross-sectional view of one embodiment of the present invention in a biased position.

FIG. 13 shows spring mechanism 400 with the star spring in an unretracted position. FIG. 14 is an end elevation view of the spring mechanism with the star spring in an unretracted position. FIG. 15 shows spring mechanism 400 with the star spring in a retracted position. Spring mechanism 400 comprises coil spring 402, washer 403, star spring 404, roller 405 and lug 406.

Coil spring 402 is a helical compression spring with a free length of approximately 1½". Coil spring 402 resides on hollow support shaft 200 within hole 310 of proximal frustroconical section 305. Coil spring 402 abuts against shoulder 303.

Washer 403 is adjacent to coil spring 402. Washer 403 biases star spring 404 against roller 405.

Star spring 404 is adjacent to washer 403. Star spring 404 is composed of a thin flexible spring steel. Star spring 404 also includes hole 401*b*. The dimensions and materials of the star spring are the same as in prior embodiments. In the preferred embodiment, the outer diameter of the prongs is larger than the outer diameter of the collar and the roller body.

Roller 405 is adjacent to and in contact with star spring 404. Roller 405 comprises frustroconical section 409, roller body 407 and lip 408. Frustroconical section 409 supports star spring 404 as it bends from an unretracted position to a retracted position. In the preferred embodiment, the diameter of end 410*a* is approximately ⅜" and the diameter at point 410*b* is 1⅜". Roller body 407 has an outer diameter of approximately 1⅜". Lip 408 is adjacent roller body 407. Lip 408 has an outer diameter of approximately 1⅝". The diameter of lip 408 may vary as long as it is sufficiently large enough to form an abutment for the paint roller cover. Roller 405 is pivotally attached to hollow support shaft 200 through hole 411. The diameter of hole 411 is greater than the outside diameter of the hollow support shaft. A tolerance of 1/16" is provided between the diameter of hole 411 and the hollow support shaft. In the preferred embodiment, roller 405 is one single piece and is composed of plastic such as polypropylene; however more than one piece or other materials may be used with equal success.

Lug 406 is adjacent roller 405. Lug 406 is a circular washer with an outer diameter of ¾". Lug 406 is welded to hollow support shaft 200. Lug 406 forms a thrust surface to prevent roller 405 from moving axially.

When spring mechanism 400 is assembled, coil spring 402 is located within proximal frustroconcial section 305 around hollow support shaft 200. Washer 403 is adjacent coil spring 402. Star spring 404 is adjacent washer 403. Roller 405 is adjacent star spring 404. Lug 406 is adjacent roller 405.

Figure 16:
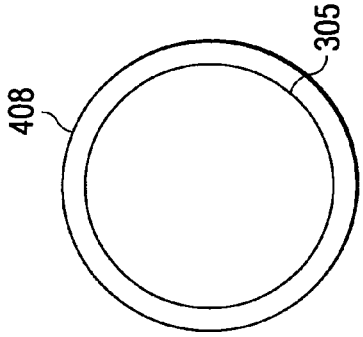
FIG. 16 is an end elevation view of FIG. 15 as seen from the plane across line H-H.

In operation, to remove the paint roller cover from roller support 300, contact surface 16 is pressed. When contact surface 16 on the button is pressed, pivot pin 19*a* pivots and pivot pin 20*a* rotate in pivot holes 19*b* and 20*b*, respectively. As pivot pins 19*a* and 20*a* rotate, activator cable 100 is pulled in a proximal direction by the rotation of curved wire support 18*a*. In turn, activator cable 100 moves end cap 30. Roller support 300 is pushed towards spring mechanism 400 by pressure exerted on its distal end by end cap 30. As roller support 300 moves towards spring mechanism 400, edge 308 bends star spring 404 proximally along slant 412 on frustroconical section 309. As shown in FIG. 15, when star spring 404 bends along slant 412 on frustroconical section 309, star spring prongs 401*a* are retracted. FIG. 16 shows an end view across line H-H with star spring 404 in the retracted position. When spring star 404 is retracted, the paint roller cover can be easily removed from the paint roller frame.

The arrangement of spring mechanism 400 allows the paint roller cover to be slid onto and secured to the paint roller frame without any remote actuation. In this embodiment, the prongs of the star spring can be biased by the interior of the paint roller cover, but once biased, the prongs must be retracted for the paint roller cover to be removed.

The dimensions of proximal frustroconical section 305, edge 308, coil spring 402, washer 403, star spring 404, roller 405 and lug 406 may vary depending on the dimensions of hollow support shaft 200, roller support 300 and the paint roller cover. However, in order for this embodiment of the invention to function properly, the outside diameter of star spring 404 must be greater than the outside diameter of proximal frustroconical section 305 and roller 405. Additionally, the difference in diameters of frustroconical section 409 and roller body 407 must be large enough to allow star spring 404 to bend into a retracted position by curving star spring 404 over frustroconical section 409.

Figure 17A:
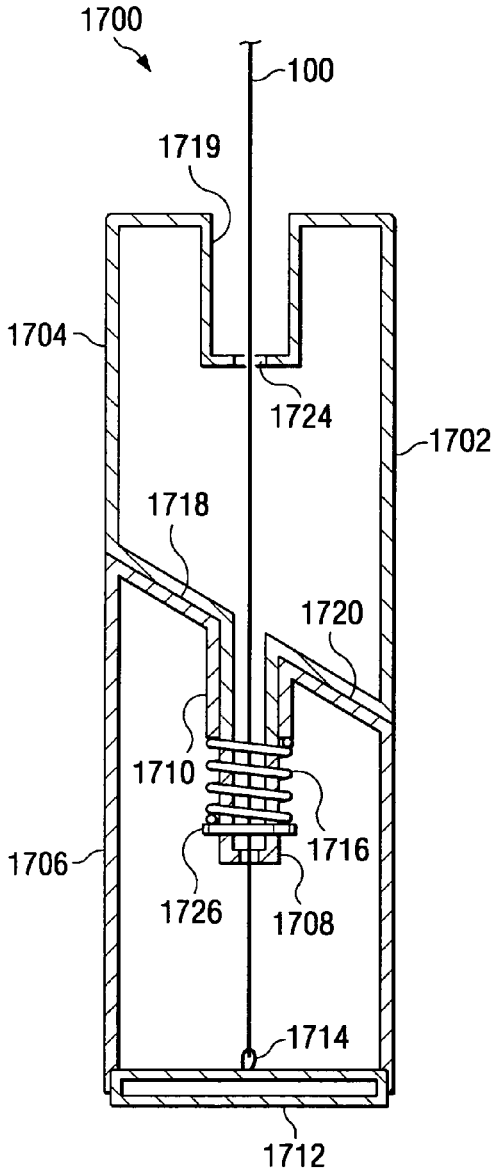
FIG. 17*a* is a cutaway view of an alternate embodiment of the handle of the invention.

There are several preferred embodiments of the handle of the invention. For example, FIG. 17*a* shows the alternate embodiment of the handle as handle 1700. The handle section is a generally rectangular hollow member having a downwardly sloping face 1720. Handle 1700 has an upper handle half 1702 and 1704. When assembled, upper handle half 1702 and 1704 form the upper handle section of the invention. The upper handle section has a cylindrical shaft recess 1719 for receiving the hollow support shaft. The hollow support shaft is rigidly affixed in cylindrical shaft recess 1719 by inductive welding. Cylindrical shaft recess 1719 includes hole 1724. The upper handle section includes sloping face 1720. Sloping face 1720 includes receiving cylinder 1710. Receiving cylinder 1710 is a cylindrical member generally aligned with cylindrical shaft recess 1719. It is integrally formed with upper handle half 1702 and upper handle half 1704 and therefore rigidly affixed thereto.

Handle 1700 also includes lower handle section 1706. Lower handle section 1706 is a generally rectangular hollow member having a downward sloping face 1718. Lower handle section 1706 includes receiving cylinder 1710 which is a generally cylindrical member integrally formed with lower handle section 1706 and axially aligned with aligning cylinder 1708 and cylindrical shaft recess 1719.

Aligning cylinder 1708 is adapted to fit within and extend below receiving cylinder 1710. Aligning cylinder 1708 is also adapted to be connected with and rotate within receiving cylinder 1710. Aligning cylinder 1708 is also adapted to slide axially within receiving cylinder 1710.

Aligning cylinder 1708 includes a retaining washer 1726, which is rigidly affixed to aligning cylinder 1708 through inductive welding. Spring 1716 is resident on aligning cylinder 1708 and retained in an abutment position with receiving cylinder 1710 by retaining washer 1726. Spring 1716 in the preferred embodiment is a coil spring, however, those skilled in the art will recognize that other spring configurations are possible.

Bottom 1712 is rigidly affixed to lower handle section 1706. Bottom 1712 includes a cable tie 1714. Cable 100 is operably disposed through the interior of the hollow support shaft, through hole 1724, aligning cylinder 1708 and attached to cable tie 1714.

Figure 17B:
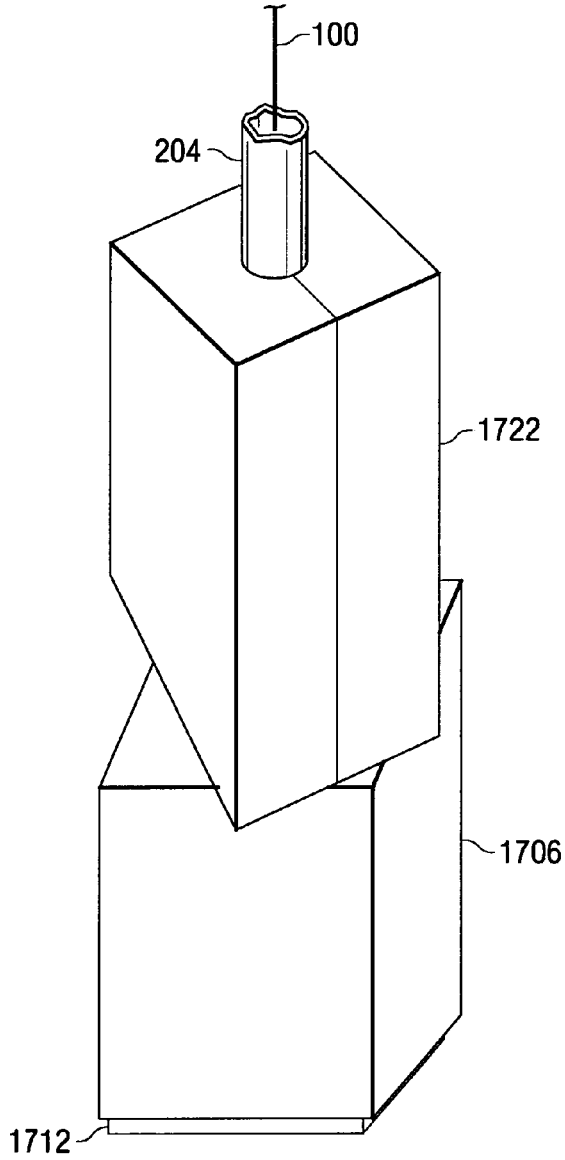
FIG. 17*b* is an isometric view of the operation of an alternate embodiment of the handle of the invention.

In operation, handle 1700 operates to place tension on cable 100 as shown best in FIG. 17*b*. FIG. 17*b* shows that upper handle section 1722 is capable of rotating about its axis with respect to lower handle section 1706. As aligning cylinder 1708 rotates within receiving cylinder 1710. As upper handle section 1722 is rotated about its axis with respect to lower handle section 1706, it is moved away from bottom 1712 by the interaction of sloping face 1718 and sloping face 1720. In response, cable 100, attached to cable tie 1714, is placed in tension and drawn downward with respect to hollow support shaft 204, thereby actuating the functions of the invention.

Figure 18:
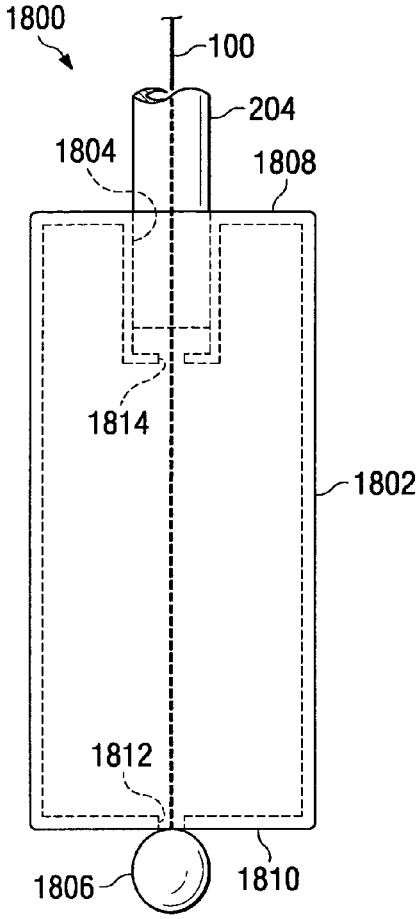
FIG. 18 is view of an alternate embodiment of the handle of the invention.

Another example of a preferred embodiment of the handle is shown in FIG. 18 as handle 1800. Handle 1800 includes hollow handle section 1802. Hollow handle section 1802 is a generally hollow rectangular box including a top 1808 and a bottom, 1810. Hollow handle section 1802 includes a cylindrical mounting recess 1804 for receiving hollow support shaft 204. Cylindrical mounting recess 1804 also includes concentric hole 1814. Hollow support shaft 204 is rigidly attached to and held in cylindrical mounting recess 1804 by inductive welding.

Handle 1800 includes a hole 1812 in bottom 1810. Handle 1800 also includes knob 1806. Knob 1806 is rigidly attached to cable 100 which proceeds through concentric hole 1814 to the interior of hollow support shaft 204.

In operation, handle 1800 is utilized by holding hollow handle section 1802 in one hand and pulling knob 1806 with the other. Knob 1806 applies a tension force to cable 100 for operation of the invention.

Figure 19A:
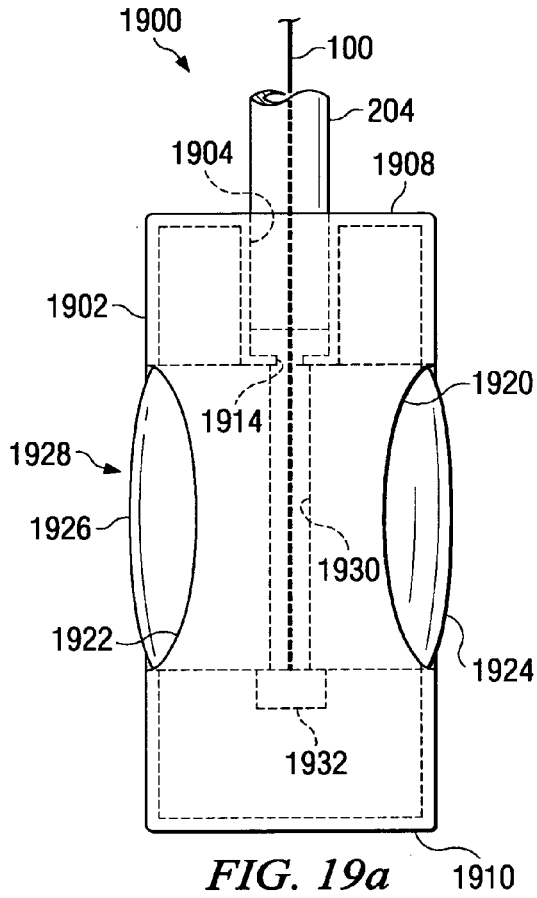
FIG. 19*a* is a view of an alternate embodiment of the handle of the invention.

Yet another embodiment of the handle of the invention is shown in FIG. 19 as handle 1900. Handle 1900 includes hollow handle section 1902. Hollow handle section 1902 is a generally rectangular handle including a top 1908 and a bottom, 1910. Hollow handle section 1902 includes a cylindrical mounting recess 1904 for receiving hollow support shaft 204. Cylindrical mounting recess 1904 also includes concentric hole 1914. Hollow support shaft 204 is rigidly attached to and held in cylindrical mounting recess 1904 by inductive welding.

Figure 19B:
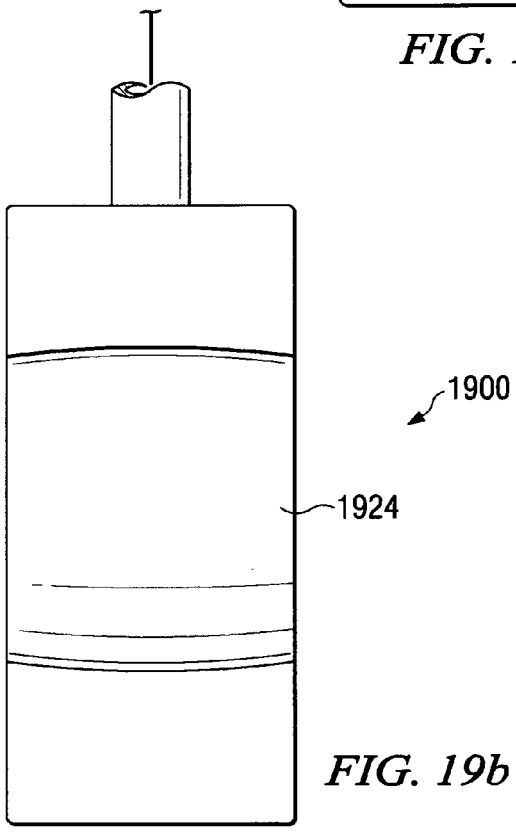
FIG. 19*b* is a view of an alternate embodiment of the handle of the invention.

Handle 1900 also includes handle cutouts 1920 and 1922. Handle cutouts 1920 and 1922 in the preferred embodiment are located in opposing faces of handle 1900. Exposed bladder sections 1924 and 1926 protrude through handle cutouts 1920 and 1922 respectively. FIG. 19*b* shows an alternate view of handle 1900 and exposed bladder section 1924. Exposed bladder section 1924 and exposed bladder section 1926 are integrally formed with bladder 1928. Bladder 1928 is a sealed natural rubber membrane capable of expanding and contracting based on pressure exerted on the bladder sections. Other resilient membrane material will also suffice. In the preferred embodiment the bladder is filled with a non-toxic incompressible gel to facilitate maximum response to any compressive movement. The bladder may also simply be filled with air. Bladder 1928 includes rigid axial cylinder 1930 which traverses from the top of the bladder to the bottom, forming a passage therethrough. Bladder 1928 is rigidly affixed to the bottom of rigid axial cylinder 1930. Retaining collar 1932 is rigidly affixed to the bottom of bladder 1928 directly adjacent to rigid axial cylinder 1930. Retaining collar 1932 is attached to bladder 1928 in a manner which allows retaining collar 1932 to move as bladder 1928 expands. Cable 100 traverses the interior of hollow support shaft 204 through concentric hole 1914 and rigid axial cylinder 1930 and is rigidly affixed to retaining collar 1932.

In operation, exposed bladder sections 1924 and 1926 are squeezed, whereby the bottom of the bladder expands and retaining collar 1932 is displaced downwardly, applying tension to cable 100 for operation of the invention.

This invention is susceptible to considerable variation in its practice. Accordingly, this invention is not limited to the specific exemplifications set forth herein above. Rather, this invention is within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part of the invention under the doctrine of equivalents.

The invention claimed is:

1. A frame for releasably holding a paint roller cover comprising:

a handle having a movable actuator;

a hollow support shaft connected to the handle;

a roller support pivotally attached to the hollow support shaft;

a spring mechanism adjacent to the roller support and pivotally attached to the hollow support shaft;

a cable connected to the actuator and the roller support;

the actuator extending from the handle;

a cable support surface connected to the actuator and to the cable;

a pivotal attachment means, rigidly connected to the cable support surface and pivotally connected to the handle; and, wherein movement of the actuator changes a position of the cable and moves the spring mechanism to a position to release the paint roller cover.

2. The frame of claim 1 wherein the actuator comprises:

a flexible bladder attached to the handle;

a cable support attached to the bladder and connected to the cable; and whereby compression of at least one portion of the bladder moves the cable.

3. The frame of claim 1 wherein the actuator comprises a knob.

4. The frame of claim 1 wherein the actuator comprises:

an upper handle section having a downward facing engagement face;

the downward facing engagement face having an alignment first alignment member;

a lower handle section having an upward facing engagement face;

the upward facing engagement face having a second alignment member;

the first alignment member cooperating with the second alignment member to fix an axis of the upper handle with respect to an axis of the lower handle;

the lower handle section connected to the cable;

the upper handle section connected to the hollow support shaft; and whereby rotation of the upper handle section with respect to the lower handle section moves the cable.

5. The frame of claim 1 wherein the hollow support shaft comprises:

a hollow horizontal support rod;

a lug connected to the hollow horizontal support rod;

a hollow curved support rod connected to the hollow horizontal support rod;

a washer connected to the hollow curved support rod; and wherein the washer connects the hollow support shaft by securing the washer in the first mating member and the second mating member.

6. The frame of claim 5 wherein the roller support comprises:

a proximal roller support section rotationally connected to the hollow support shaft; and a distal roller support section pivotally attached to the hollow support shaft section;

a spacer connected to the proximal roller support section and the distal roller support section, and a variable dimension end cap connected to the cable and the distal support section.

7. The frame of claim 6 wherein the variable dimension end cap further comprises:

a centering shaft and a receiving shaft;

wherein the a centering shaft comprises a centering hole; and a first helical centering face; and wherein the receiving shaft further comprises:

a receiving hole;

a second helical receiving face; and a receiving notch;

and wherein the first helical support surface and the second helical support surface cooperate to extend a dimension of the variable dimension end cap.

8. The frame of claim 7 wherein the length of the cable is adjusted by rotating the centering shaft with respect to the receiving shaft.

9. The frame of claim 1 wherein the spring mechanism comprises:

a retaining ring pivotally mounted to the hollow support shaft;

a roller pivotally mounted on the hollow support shaft and connected to the retaining ring;

a thrust resisting washer mounted on the hollow support shaft between the retaining ring and the roller pivot such that axial movement of the thrust resisting washer is resisted;

a star spring pivotally mounted on the hollow support shaft and adjacent the roller;

a coil spring mounted on the hollow support shaft and interspersed between the roller and the star spring;

a collar pivotally mounted on the hollow support shaft and connected to the roller; and a connection means for connecting the retaining ring, roller and collar.

10. The frame of claim 1 wherein the spring mechanism comprises:

a thrust washer rigidly affixed to the hollow support shaft;

a roller pivotally mounted on the hollow support shaft adjacent the thrust washer;

a star spring pivotally mounted on the hollow support shaft adjacent the roller;

a washer pivotally mounted on the hollow support shaft adjacent the star spring; and a coil spring mounted on the hollow support shaft and adjacent the washer.

11. A method of removing a paint roller cover from a frame comprising the steps of:

providing a handle having a movable button;

providing a hollow support shaft connected to the handle;

providing a roller support pivotally attached to the hollow support shaft;

providing a spring mechanism adjacent to the roller support and pivotally attached to the hollow support shaft and having retractable prongs;

providing a cable connected to the button and the roller support through the hollow support shaft; and pressing the button whereby the movement of the button changes the position of the cable and moves the retractable prongs to a position to release the paint roller cover.

12. The method of claim 11 further comprising the steps of:

providing a curved cable support connected to the button;

providing a cable support means for connecting the cable to the curved cable support; and pivotally attaching the curved cable support to the handle.

13. The method of claim 11 comprising the further steps of:

a proximal frustroconical section on the roller support; and providing a support member attached to the proximal frustroconical section;

providing a distal frustroconical section attached to the support member; and p1 providing an end cap attached in the support member.

14. The method of claim 13 further comprising the step of adjusting the end cap to change the length of the cable.

15. The method of claim 14 wherein the step of adjusting further comprises moving a cylindrical helical centering face of the end cap with respect to a cylindrical helical receiving face of the end cap.

16. The method of claim 14 comprising the further step of moving a plunger to engage the spring mechanism.

17. The method of claim 11 comprising the further steps of:

providing a star spring having prongs which can be extended and retracted;

retracting the prongs to release a paint roller cover; and extending the prongs to engage a paint roller cover.

18. An apparatus for releasably holding a paint roller cover comprising:

a handle;

a hollow support tube rigidly fixed in the handle;

an actuator attached to the handle;

a cable attached to the actuator;

a roller pivotally attached to the hollow support tube and adapted to receive the paint roller cover;

the roller support having a spring loaded set of retractable radial prongs; and the cable operationally attached to the roller whereby when the actuator is moved, the prongs are retracted to release the paint roller cover.

19. The apparatus of claim 18 wherein the roller further comprises:

a retainer means, operationally connected to the roller and the hollow support shaft, for resisting axial movement of the roller and respect to the support shaft;

a cylindrical keeper, connected to the retainer means and pivotally suspended on the hollow support shaft;

the keeper having a set of concave radial slots;

a radial flat spring, disposed within the set of concave radial slots, having radially extending contact arms which can be extended out of surface of the roller and retracted into the surface of the roller; and an engagement means for contacting the radial flat spring upon actuation of the cable and depressing the radial flat spring into the set of concave radial slots and retracting the contact arms.

20. The apparatus of claim 19 wherein the engagement means further comprises:

a cylindrical plunger attached to the roller adjacent the radial flat spring; and a return coil spring between the radial flat spring and the keeper.

21. The apparatus of claim 18 wherein the roller further comprises:

a cylindrical keeper, connected to the retainer means and pivotally suspended on the hollow support shaft;

a stanchion adjacent the retainer means;

a radial flat spring adjacent the stanchion having radially extending contact arms which can be extended beyond the surface of the roller and retracted within the surface of the roller; and a contact surface adjacent the contact arms for moving the contact arms with respect to the stanchion.

22. The apparatus of claim 18 further comprising:

an adjustable end cap attached to the roller and the cable; and whereby the length of the cable may be adjusted by manipulation of the adjustable end cap.

23. The apparatus of claim 22 wherein the end cap further comprises:

a first cylindrical member having a top and a first helical set of engagement teeth;

a second cylindrical member having a bottom and second helical set of engagement teeth engaged with the first helical set of engagement teeth; and whereby rotation of the first cylindrical member with respect to the second cylindrical member adjusts the distance between the top and the bottom.

24. The apparatus of claim 18 wherein the actuator comprises:

a flexible bladder attached to the handle;

a cable support attached to the bladder and connected to the cable; and whereby compression of at least one portion of the bladder moves the cable support.

25. The apparatus of claim 18 wherein the actuator comprises a knob.

26. The apparatus of claim 18 wherein the actuator comprises:

an upper handle section having a downward facing engagement face;

the downward facing engagement face having an alignment first alignment member;

a lower handle section having an upward facing engagement face;

the upward facing engagement face having a second alignment member;

the first alignment member cooperating with the second alignment member to fix an axis of the upper handle with respect to an axis of the lower handle;

the lower handle section connected to the cable;

the upper handle section connected to the hollow support shaft; and whereby rotation of the upper handle section with respect to the lower handle section moves the cable.

27. A method of releasably attaching a paint roller cover to a paint roller having a handle with an actuator, a hollow support rod, a roller support, a cable within the hollow support rod connecting the bottom and the roller support and a spring loaded cylinder having retractable prongs comprising the steps of:

moving the actuator;

moving the cable;

moving the roller axially with respect to the hollow support rod;

retracting the retractable prongs; and sliding the paint roller cover onto the roller support and the spring loaded cylinder.

28. The method of claim 27 further comprising the step of adjusting the position of the cable with respect to the roller support by adjusting an end cap.

29. The method of claim 28 further comprising the steps of:

adjusting the end cap; and rotating a first end cap cylinder with respect to a second end cap cylinder.

30. The method of claim 27 wherein the step of moving the actuator comprises depressing the actuator.

31. The method of claim 27 wherein the step of moving the actuator comprises rotating the actuator.

32. The method of claim 27 wherein the step of moving the actuator comprises compressing the actuator.

* * * * *